US008285176B2

(12) United States Patent
Yamaguchi

(10) Patent No.: US 8,285,176 B2
(45) Date of Patent: Oct. 9, 2012

(54) APPARATUS AND SPACER FOR USE THEREIN

(75) Inventor: Wataru Yamaguchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 329 days.

(21) Appl. No.: 12/730,299

(22) Filed: Mar. 24, 2010

(65) Prior Publication Data

US 2010/0247145 A1 Sep. 30, 2010

(30) Foreign Application Priority Data

Mar. 26, 2009 (JP) ..... 2009-076794

(51) Int. Cl.
*G03G 15/08* (2006.01)

(52) U.S. Cl. ..... 399/121; 399/411

(58) Field of Classification Search ..... 399/121, 399/411; 206/814
See application file for complete search history.

(56) References Cited

U.S. PATENT DOCUMENTS 6,014,531 A * 1/2000 Ebata et al. ..... 399/69
6,343,198 B1 * 1/2002 Sato ..... 399/121
6,775,494 B2 * 8/2004 Kusaba et al. ..... 399/111
7,773,909 B2 * 8/2010 Rumpel et al. ..... 399/107
2005/0191087 A1 * 9/2005 Nishimura ..... 399/111
2006/0072929 A1 * 4/2006 Takahashi ..... 399/13
2007/0041762 A1 * 2/2007 Ishida et al. ..... 399/388
2007/0110476 A1 * 5/2007 Lee et al. ..... 399/121
2009/0016768 A1 1/2009 Seorl et al.

FOREIGN PATENT DOCUMENTS

JP 11-130146 A 5/1999
JP 2006-350119 A 12/2006
JP 2007-101728 A 4/2007
JP 2008-203741 A 9/2008
JP 2009020515 A 1/2009

OTHER PUBLICATIONS

Notice of Reasons for Rejection for Japanese Patent Application No. 2009-076794 mailed Mar. 15, 2011 along with partial English translation.

* cited by examiner

*Primary Examiner* — David Gray
*Assistant Examiner* — G. M. Hyder
(74) *Attorney, Agent, or Firm* — Banner & Witcoff, Ltd.

(57) ABSTRACT

A spacer configured to minimize movement of a transfer unit (for example, a belt unit) is described. An apparatus may include a main body and a transfer unit disposed in the main body. The spacer may include various contact portions that contact a portion of the transfer unit and a portion of the main body to minimize relative movement of the transfer unit.

19 Claims, 16 Drawing Sheets

APPARATUS AND SPACER FOR USE THEREIN

CROSS REFERENCE TO RELATED APPLICATION

This application claims priority from Japanese Patent Application No. 2009-076794, filed on Mar. 26, 2009, the entire subject matter of which is incorporated herein by reference.

FIELD

Aspects of the invention relate to an image forming apparatus including a transfer unit, and a spacer configured to reduce movement of the transfer unit in the image forming apparatus.

BACKGROUND

A known image forming apparatus includes a transfer unit, e.g., belt unit. The belt unit includes a pair of rollers, a frame holding the rollers, and an endless belt extending around the rollers. Generally, the belt unit is detachably attached to an apparatus body, e.g. a main body frame, of the image forming apparatus.

In the image forming apparatus, a locking mechanism is provided which engages a supporting portion that protrudes inward from a side of the apparatus body and a supported portion that protrudes in a width direction of the belt unit. The belt unit is fixed to the apparatus body by the locking mechanism. Thus, the locking mechanism, the supported portion and the supporting portion make the outer dimensions of the belt unit increased especially in the width direction.

If the size of the locking mechanism is decreased, the outer dimensions of the belt unit may be prevented from increasing, but a fixing force to fix the belt unit to the apparatus body may become undesirably small. Thus, when the image forming apparatus is moved, the belt unit may be accidentally moved out of position with respect to the apparatus body due to an excitation force applied to the image forming apparatus.

SUMMARY

On the other hand, when the image forming apparatus is used, the excitation force is not applied to the image forming apparatus, and thus the locking mechanism that exerts a great fixing force which bears the excitation force during movement of the image forming apparatus becomes unnecessary. In addition, if the locking mechanism is configured to exert a great fixing force, the size of the locking mechanism may be increased, and the size of the image forming apparatus may be also increased.

Aspects of the invention may provide an image forming apparatus in which the need to increase the physical size of the image forming apparatus is reduced while minimizing movement of a belt unit in an apparatus body of the image forming apparatus.

BRIEF DESCRIPTION OF THE DRAWINGS

Illustrative aspects of the invention will be described in detail with reference to the following figures in which like elements are labeled with like numbers and in which.

DETAILED DESCRIPTION

An illustrative embodiment of the invention will be described in detail with reference to the accompanying drawings. Aspects of the invention are applied to an image forming apparatus, e.g. an electrophotographic image forming apparatus, a spacer configured to reduce movement of a belt unit in the image forming apparatus, and a structure of the spacer.

A first embodiment of the invention will be described.

The general structure of an illustrative image forming apparatus 1 will be described with reference to FIG. 1.

For ease of discussion, in the following description, the top or upper side, the bottom or lower side, the left or left side, the right or right side, the front or front side, and the rear or rear side of the image forming apparatus 1 will be identified as indicated by the arrows in FIG. 1. With regard to various individual objects of the image forming apparatus 1, sides of the individual objects will be similarly identified based on the arranged/attached position of the object on/in the image forming apparatus 1 shown in FIG. 1. The top and bottom direction may be referred to as a height direction, and the left and right direction may be referred to as a width direction.

Figure 1:
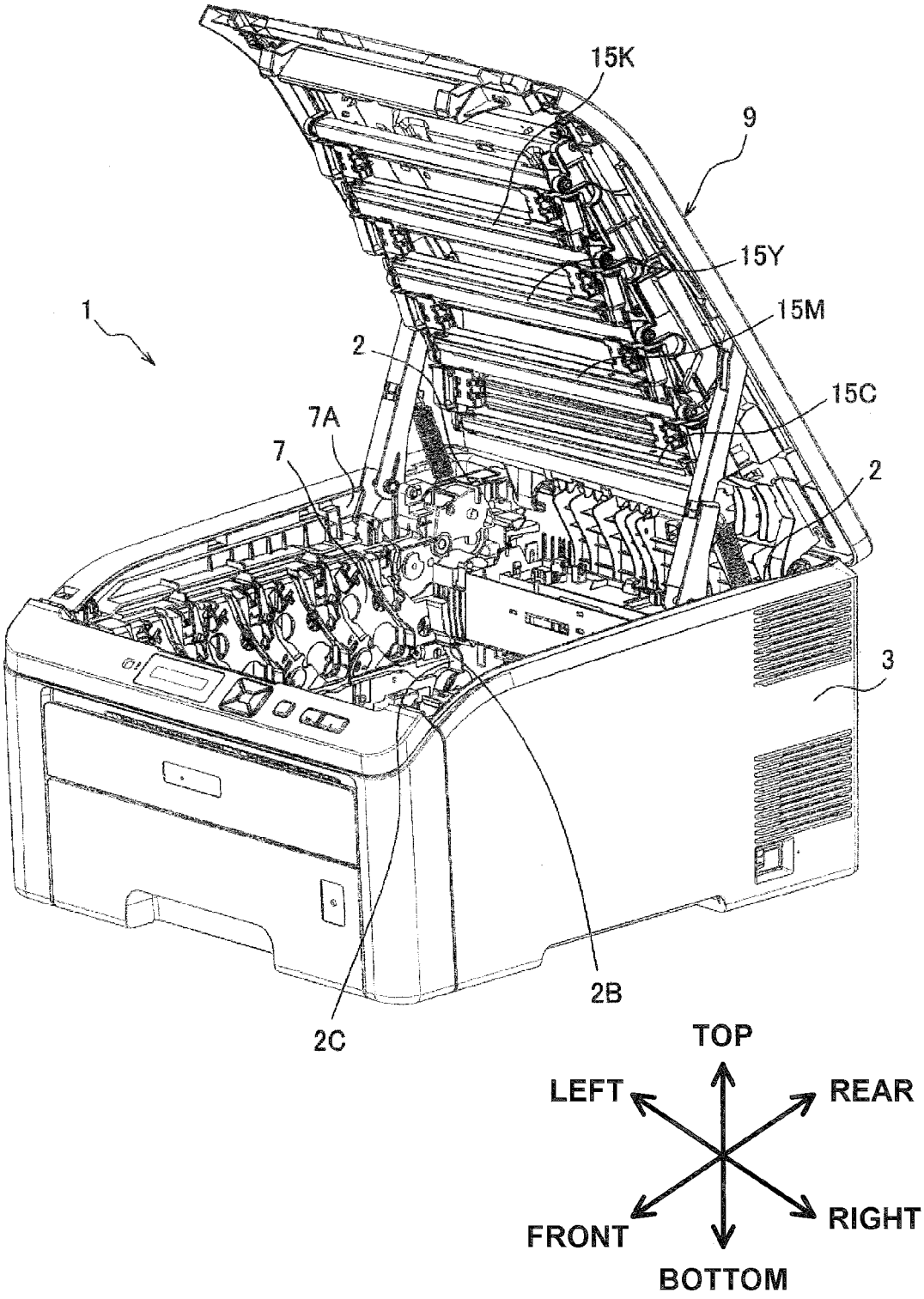
FIG. 1 is a perspective view of an image forming apparatus in which a top cover is open according to an illustrative embodiment.
Figure 2:
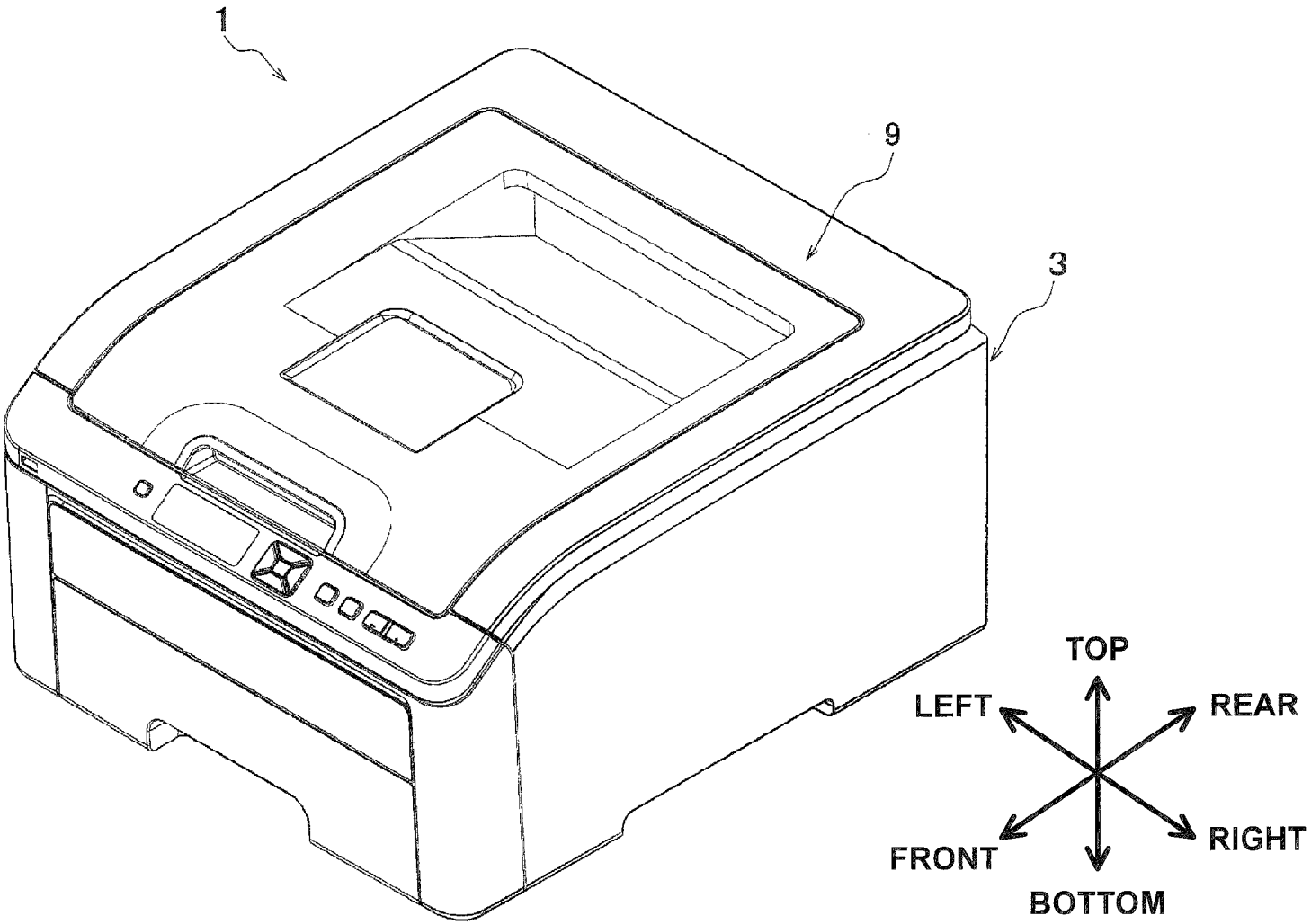
FIG. 2 is a perspective view of the image forming apparatus.

As shown in FIG. 1, the image forming apparatus 1 includes a body casing 3 forming an external appearance of the image forming apparatus 1, a main body frame 2 disposed in the body casing 3, and a top cover 9 pivotally connected to a main body composed of the main body frame 2 and the body casing 3. An accommodation space 7 for accommodating an image forming unit 5 (FIG. 3) is provided inside the body casing 3. The top cover 9 is movable between an open position in which an opening 7A provided in an upper portion of the body casing 3 is exposed (as FIG. 1) and a closed position in which the opening 7A is covered (FIG. 2).

Figure 3:
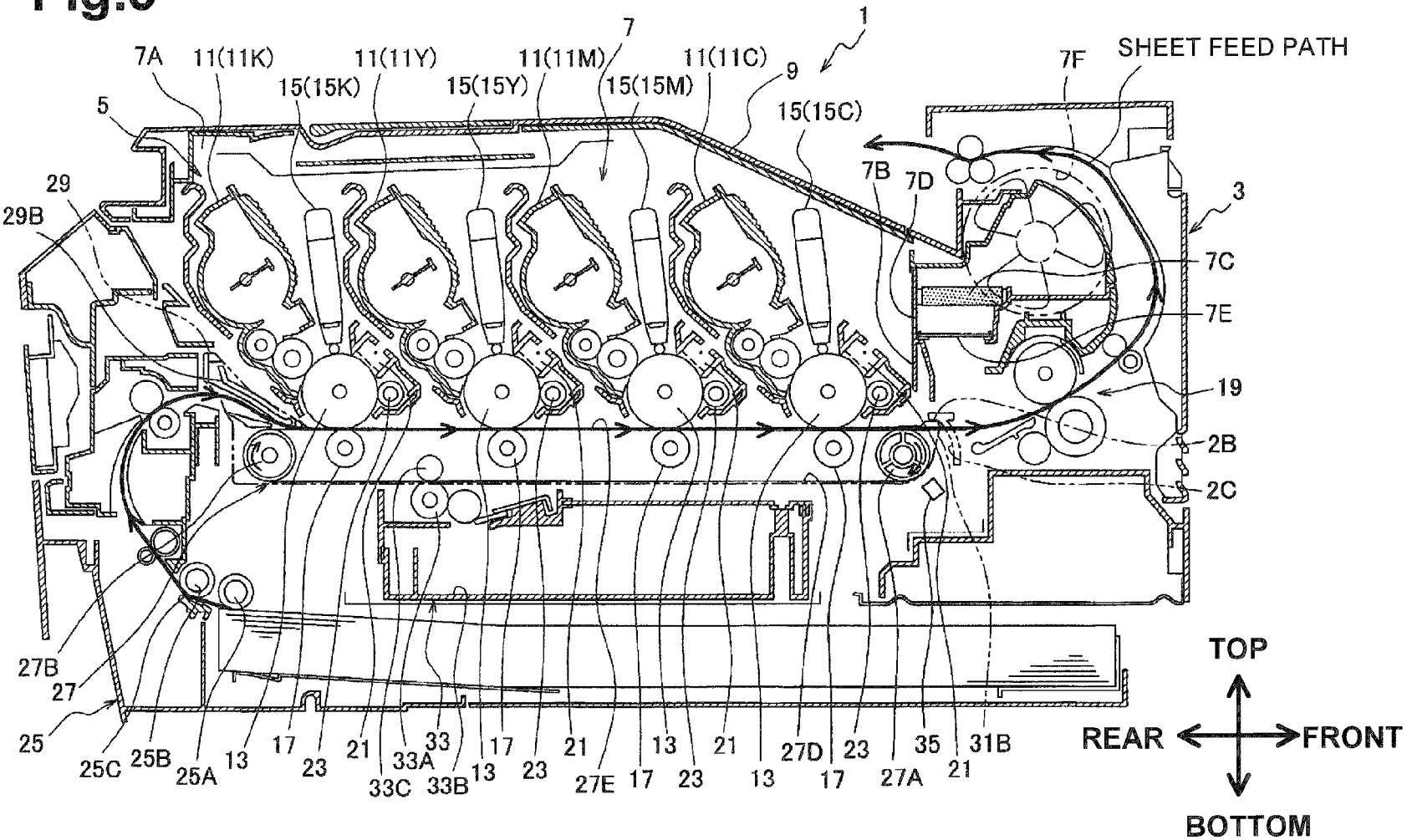
FIG. 3 is a sectional view schematically showing the image forming apparatus that is ready for use.

The image forming unit 5 is configured to form an image on a recording medium, e.g. plain and transparent sheets, (hereinafter referred to as a recording sheet) by transferring a toner image on the recording sheet. As shown in FIG. 3, the image forming unit 5 includes a plurality of, e.g. four, process cartridges 11 (11K, 11Y, 11M, and 11C), photosensitive drums 13, exposure devices 15 (15K, 15Y, 15M, and 15C), transfer rollers 17, and a fixing unit 19. The process cartridges 11 each contain developer. The process cartridge 11K contains a black developer, 11Y containing a yellow developer, 11M containing a magenta developer, and 11C containing a cyan developer. The photosensitive drums 13 are configured to carry developer images of the corresponding colors thereon. The exposure devices 15 are configured to expose the corresponding photosensitive drums 13. The transfer rollers 17 are configured to transfer the developer images on the photosensitive drums 13 onto a recording sheet. The fixing unit 19 is configured to fix the developer images transferred onto the recording sheet by heat.

The image forming unit 5 employs a direct tandem type in which the process cartridges 11K, 11Y, 11M, and 11C are arranged and spaced apart in a sheet feeding direction and a plurality of types of developer images are directly transferred onto a recording sheet.

Each process cartridge 11 includes a photosensitive drum 13, a charger 21 for charging the photosensitive drum 13, and a cleaner 23 for cleaning a surface of the photosensitive drum 13 after image transfer is completed.

Figure 8:
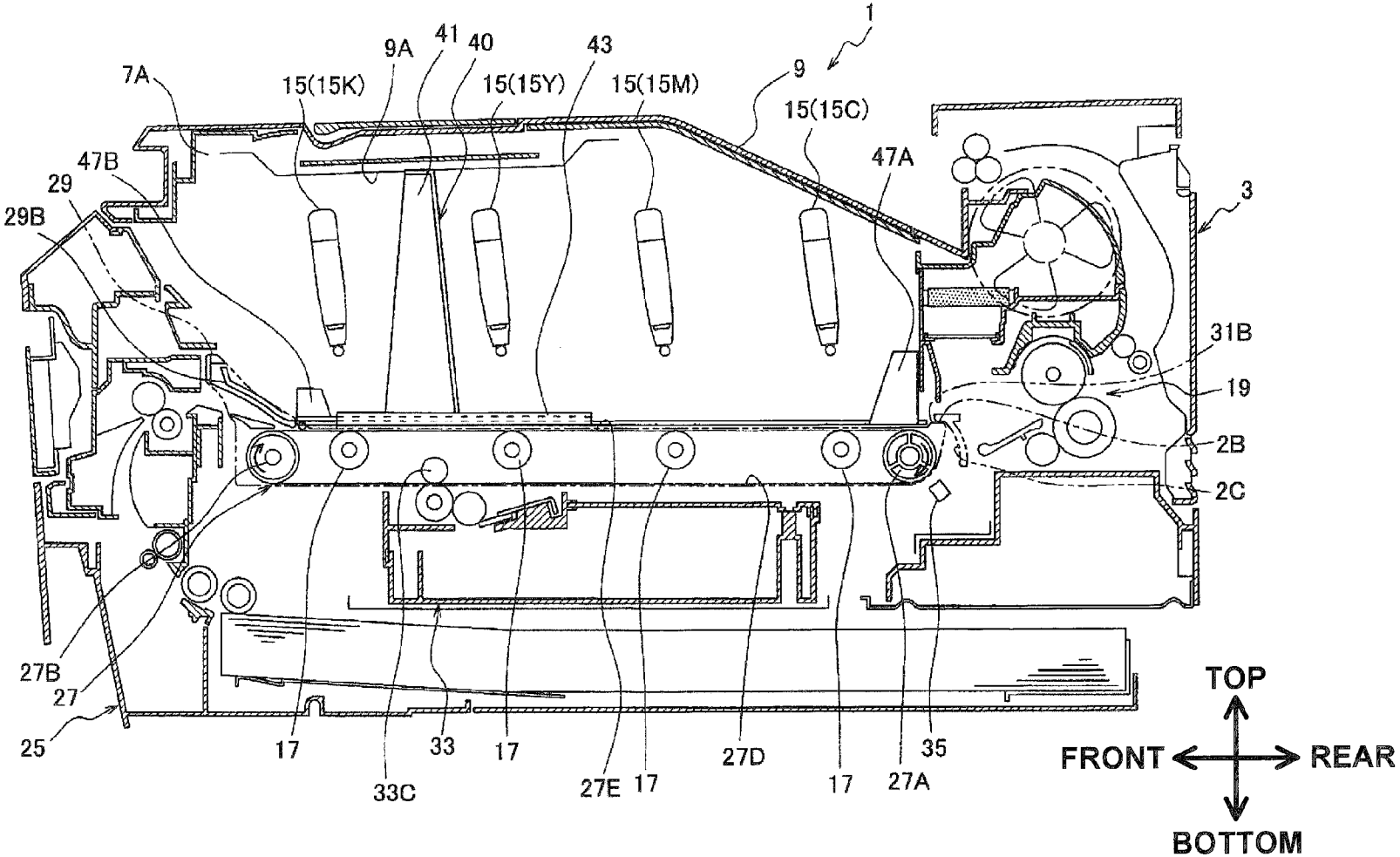
FIG. 8 is a sectional view of the image forming apparatus in which a spacer is attached.

Each process cartridge 11 is detachably attached to the main body frame 2 of the main body so as to be removed through the opening 7A when the top cover 9 is open. When the process cartridges 11K, 11Y, 11M, and 11C are removed from the main body and the top cover 9 is closed, a flat surface portion 27E of a belt unit 27 faces an inner surface of the top cover 9 as shown in FIG. 8.

The exposure devices 15 include four exposure devices 15K, 15Y, 15M and 15C, which are disposed in paired relationship with the process cartridges 11K, 11Y, 11M and 11C and at positions corresponding to four photosensitive drums 13. Each exposure device 15 includes an LED array. The LED array includes a plurality of light emitting diodes (LEDs) that are arranged in a direction parallel to an axial direction of the photosensitive drum 13. Each exposure device 15 is configured to expose the photosensitive drum 13 by controlling flashing of LEDs.

Figure 4:
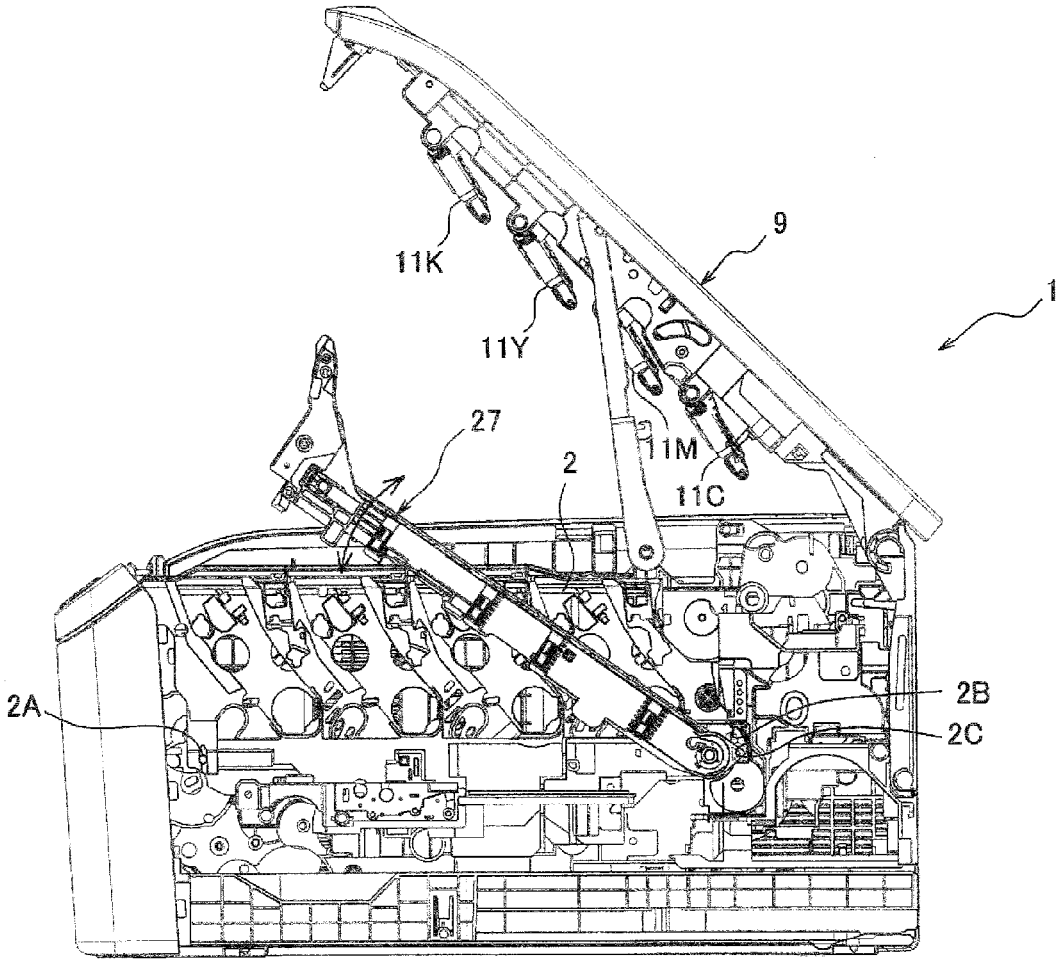
FIG. 4 is a sectional view of the image forming apparatus in which a belt unit is being removed.
Figure 4:
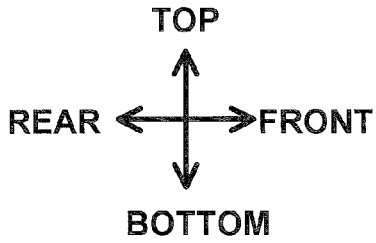

Each exposure device 15 is assembled to the top cover 9 so as to move in connection with movement of the top cover 9 between the open position and the closed position. Specifically, when the top cover 9 is open, the exposure devices 15 are disposed in proximity of the top cover 9 as shown in FIGS. 1 and 4, and when the top cover 9 is closed, the exposure devices 15 are disposed facing the photosensitive drums 13 as shown in FIG. 3.

As shown in FIG. 3, the accommodation space 7 is divided into two sections by a partition member 7B which is a part of the main body: one is a section for the fixing unit 19 (hereinafter referred to as a fixing unit-side section); and the other is a section for the process cartridges 11 (hereinafter referred to as a process cartridge-side section). The partition member 7B protects the process cartridges 11 from heat given off by the fixing unit 19.

The partition member 7B is provided with a vent 7D for introducing heat in the process cartridge-side section toward an ozone filter 7C that is disposed in the fixing unit-side section. Heat in the fixing unit-side section passes through a developer filter 7E that is disposed below the ozone filter 7C, passes through the ozone filter 7C together with heat coming from the vent 7D, and is exhausted from an air outlet 7F outside the body casing 3.

A sheet supply tray 25 is disposed in a lower portion of the image forming apparatus 1. The sheet supply tray 25 is configured to store a stack of sheets to be conveyed to the image forming unit 5. The sheets in the sheet supply tray 25 are conveyed by a pickup roller 25A, separated one by one by a separation roller 25B and a separation pad 25C, and conveyed toward a belt unit 27.

As shown in FIG. 4, the belt unit 27 is detachably attached to the main body. As shown in FIGS. 3 and 5-7, the belt unit 27 includes a pair of rollers 27A, 27B, a belt frame 27C, and a belt 27D. The pair of rollers 27A, 27B is disposed such that their axes are parallel to an axial direction of the photosensitive drums 13. The belt frame 27C holds the rollers 27A, 27B. The belt 27D is stretched between the rollers 27A and 27B.

Figure 7A:
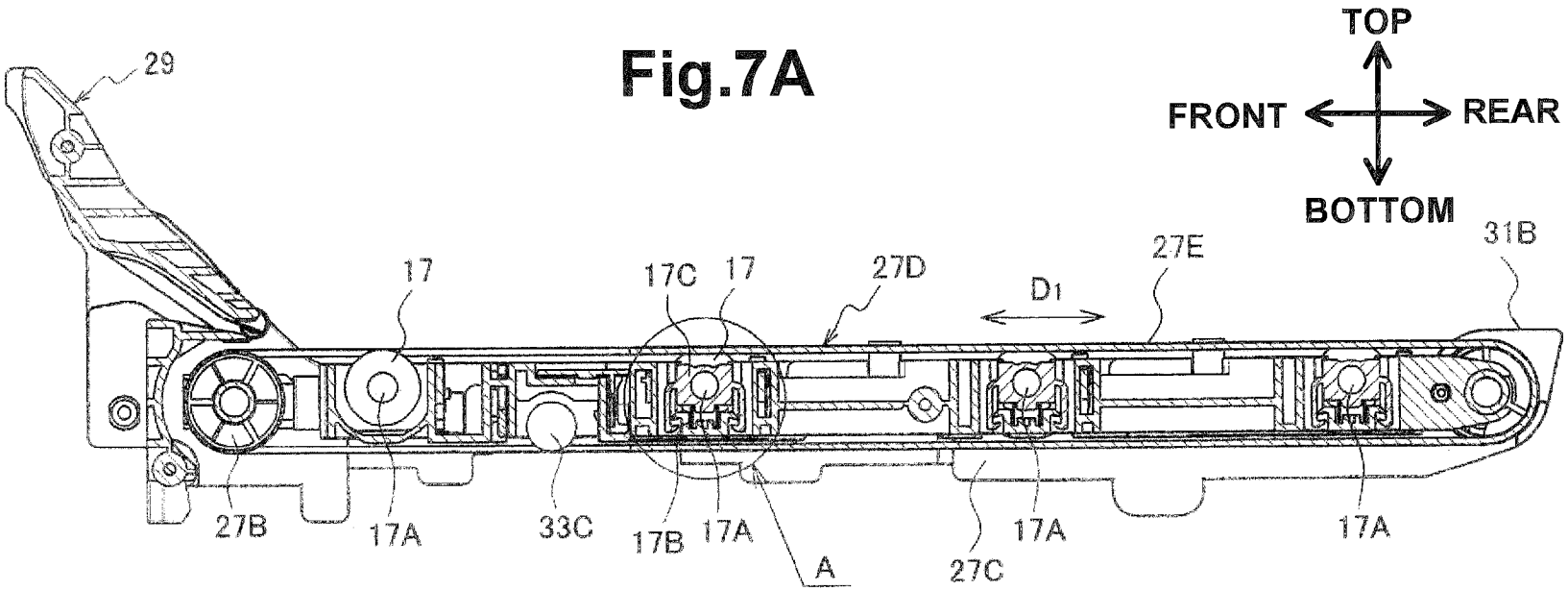
FIG. 7A is a sectional view taken along the line VI-VI of FIG. 6.

The belt 27D is an endless belt configured to rotate and convey a sheet toward the fixing unit 19. In other words, the belt 27D forms a continuous moving surface which supports a sheet. When the belt unit 27 is mounted in the main body, the flat surface portion 27E faces the four photosensitive drums 13 of the process cartridges 11. As shown in FIG. 7A, the flat surface portion 27E is a stretched, flat portion of the continuous moving surface which is formed between the rollers 27A and 27B. The four transfer rollers 17 are disposed on an opposite side of the flat surface portion 27E from the photosensitive drums 13. The transfer rollers 17 are disposed corresponding to the photosensitive drums 13 on a side of the flat surface portion 27E opposite from the photosensitive drum 13.

Figure 7B:
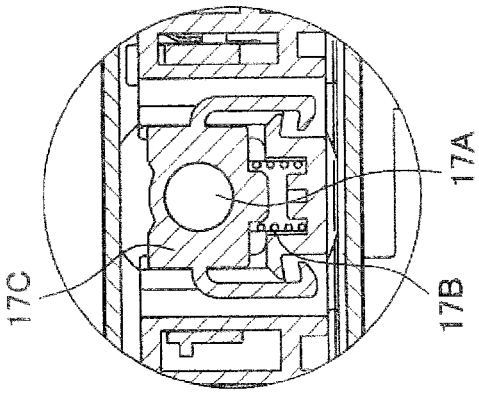
FIG. 7B is an enlarged view of an encircled portion of FIG. 7A.

As shown in FIGS. 7A and 7B, a shaft 17A of each transfer roller 17 is rotatably supported by a bearing portion 17C that is assembled to the belt frame 27C via an elastic member such as a coil spring 17B. Thus, each transfer roller 17 is elastically supported by the coil spring 17B in a direction crossing the flat surface portion 27E, e.g. in a vertical direction in FIG. 7A in this embodiment, to be pressed toward the corresponding photosensitive drum 13.

Figure 6:
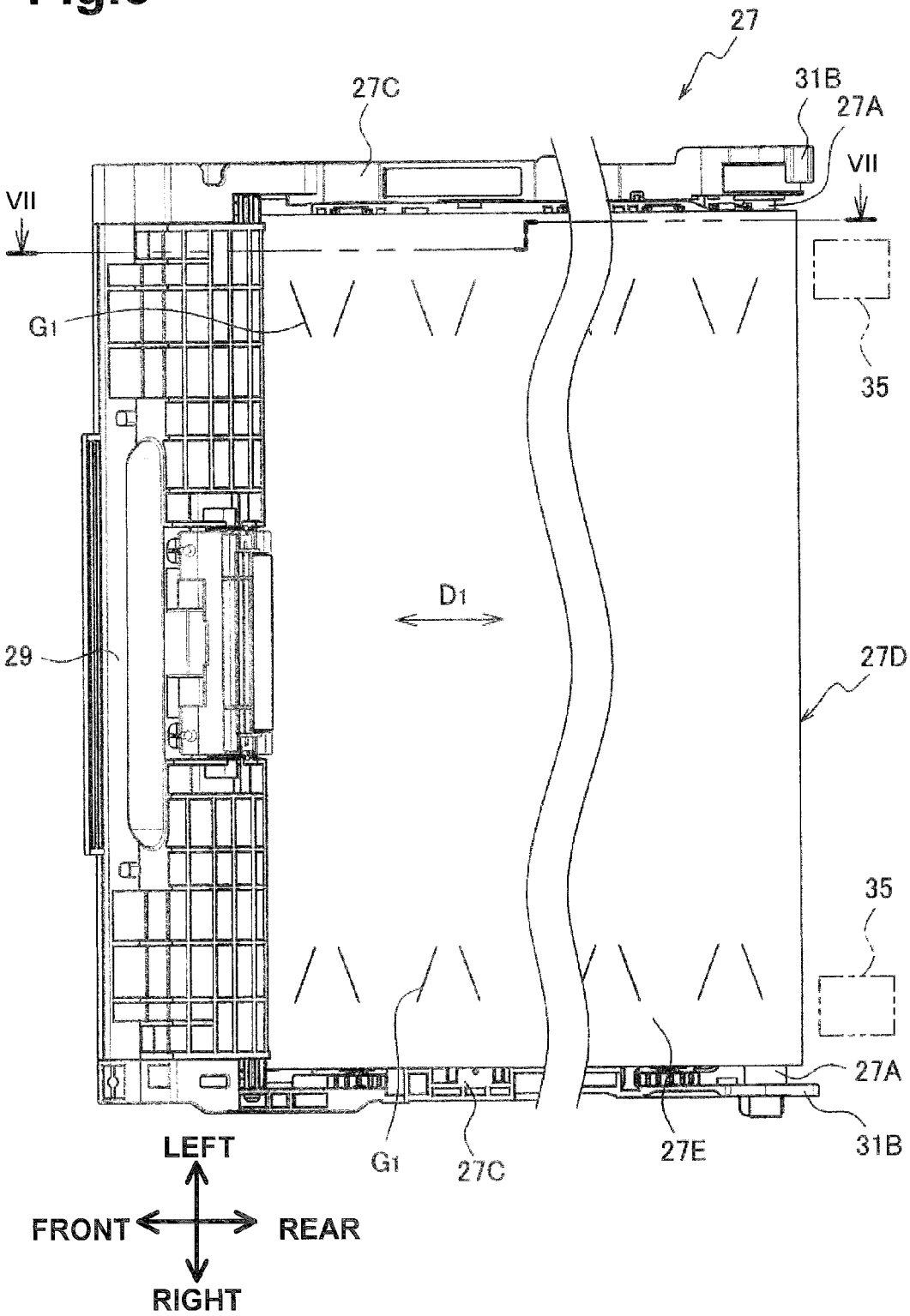
FIG. 6 is a top view of the belt unit.

As shown in FIG. 6, the belt frame 27C is formed of reinforcing members that are disposed on both longitudinal ends of each of the rollers 27A and 27B and extend in an extending direction of the flat surface portion 27E and rotatably support the rollers 27A and 27B. A handle 29 is disposed on one end of the belt frame 27C in the extending direction. In other words, the handle 29 is disposed on a front end of the belt frame 27C. When the belt unit 27 is mounted in and removed from the main body, the handle 29 is held by the user.

Figure 5:
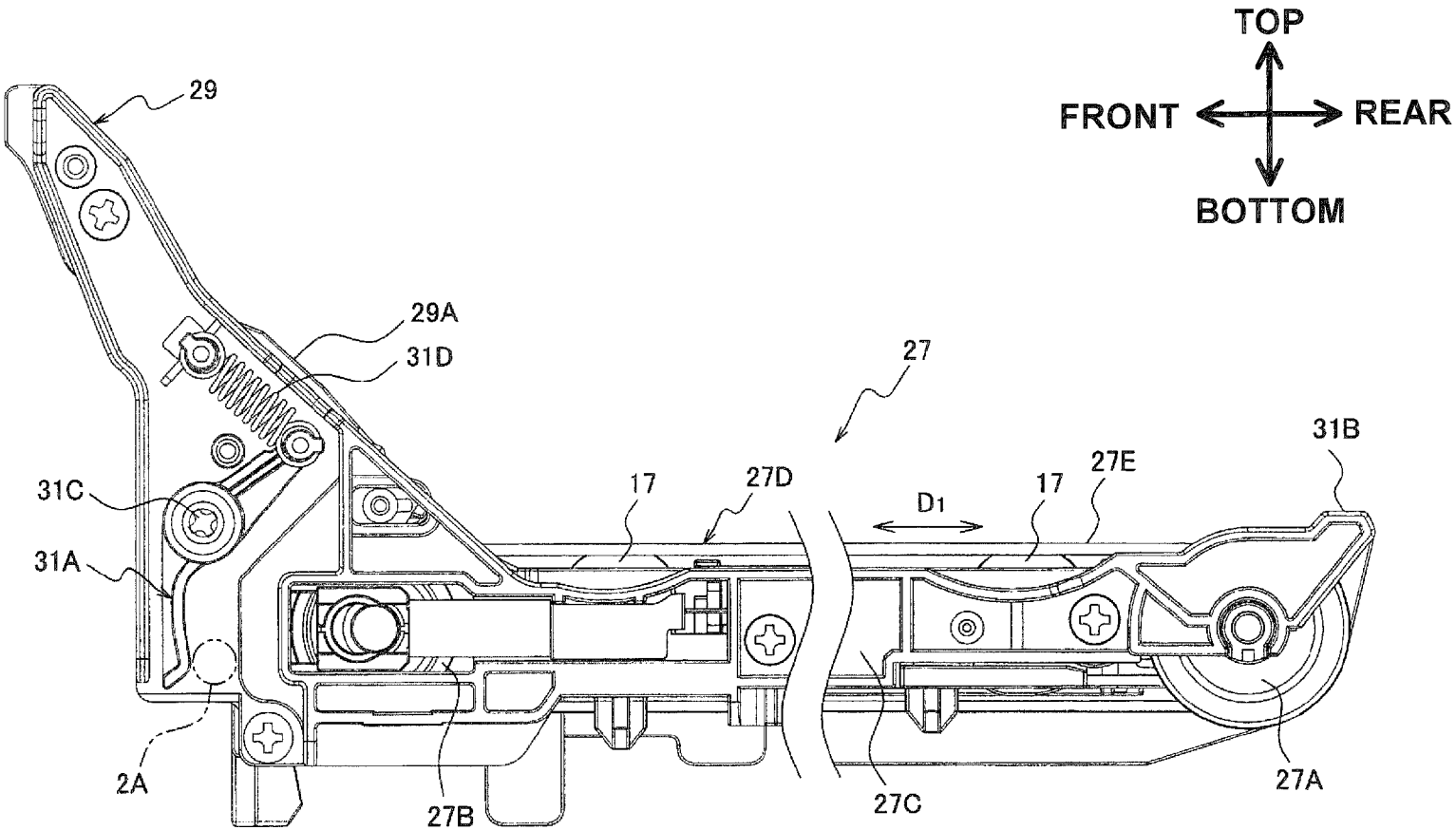
FIG. 5 is a side view of the belt unit.

The extending direction is a direction of tension acting on the flat surface portion 27E. As shown in FIG. 5, the extending direction is indicated by D1. Of the extending direction D1, a direction which is directed from the roller 27B toward the roller 27A agrees with a direction in which a recording sheet is conveyed by the belt 27D (hereinafter referred to as a sheet conveying direction) in this embodiment.

As shown in FIGS. 3 and 5, the handle portion 29 includes an inclined portion 29A and a guide portion 29B. The inclined portion 29A protrudes from the front end of the belt frame 27C in a slanting direction with respect to the flat surface portion 27E (in a slanting direction frontward and upward in FIG. 5). The guide portion 29B is disposed at the back of the inclined portion 29A (on a side where the roller 27B is disposed), and configured to turn a recording sheet, which is conveyed from the sheet supply tray 25, toward the flat surface portion 27E.

As shown in FIG. 5, the belt frame 27C is provided with an engaging lever 31A that is disposed on the front side, e.g. toward the handle 29 in this embodiment. The engaging lever 31A is configured to fix the front side of the belt unit 27C to the main frame 2. The belt unit 27C is also provided with an engaging protrusion 31B on a side opposite from the engaging lever 31A, e.g. on the rear side. The engaging protrusion 31B is configured to fix the rear side of the belt unit 27C to the main frame 2.

The engaging lever 31A is bent and is pivotally attached to the belt frame 27C at a bending portion 31C. The engaging lever 31A engages with a protruding engaged portion 2A disposed in the main frame 2 at an end toward the roller 27B, thereby fixing the front side of the belt unit 27 to the main frame 2.

The engaging lever 31A is provided with an elastic member, e.g. a coil spring 31D, at an end toward the inclined portion 29A. The coil spring 31D is configured to exert an elastic force on the engaging lever 31A to move the engaging lever 31A toward the engaged portion 2A.

As shown in FIGS. 3 and 4, the engaging protrusion 31B engages with a protruding engaged portion 2B disposed in the main frame 2, thereby fixing the rear side of the belt unit 27 to the main frame 2. In this embodiment, the engaging lever 31A and the engaging protrusion 31B serve as a locking mechanism that fixes the belt unit 27 to the main frame 2.

The engaged portion 2B is connected to a guide portion 2C that guides the engaging protrusion 31B to the engaged portion 2B. The guide portion 2C is formed to have a curved surface whose center of radius curvature is located near a center of rotation of the roller 27A when the belt unit 27 is mounted in the main frame 2.

Thus, when the belt unit 27 shown in FIG. 4 is rotated on the side of the roller 27A toward the sheet supply tray 25, e.g. downward in this embodiment, until the engaging lever 31A engages with the engaged portion 2A, the guide portion 2C guides the engaging protrusion 31B to the engaged portion 2B, the engaging protrusion 31B engages with the engaged portion 2B, a positioning protrusion (not shown) disposed in the belt unit 27 is fitted into a positioning hole (not shown) formed in the main frame 2, and thus the belt unit 27 is completely mounted in the main frame 2.

As shown in FIG. 3, a belt cleaner unit 33 is disposed on a side of the belt unit 27 opposite from the process cartridges 11 in the main frame 2. The belt cleaner unit 33 is configured to remove substances, e.g. developer residue, adhered to the belt 27D. The belt cleaner unit 33 includes a cleaning roller 33A and a collecting box 33B. The cleaning roller 33A is configured to collect and remove the substances adhered to the belt 27D in contact therewith. The collecting box 33B is configured to store the substances collected by the cleaning roller 33A.

The belt unit 27 includes a backup roller 33C that is configured to press the belt 27D toward the cleaning roller 33A. As shown in FIG. 7A, the backup roller 33C is assembled to the belt frame 27C between two transfer rollers 17 disposed toward the handle portion 29 or frontward.

The cleaning roller 33A and the backup roller 33C each include a metal portion, because a voltage is applied to the cleaning roller 33A and the backup roller 33C such that a potential difference is applied therebetween. Thus, the cleaning roller 33A and the backup roller 33C each have a relatively large mass.

In the image forming unit 5, a color image is formed by overlaying a plurality of developer images one over the other. If overlay positions are misaligned or the density of each developer image varies due to deterioration caused by aging, a color image can not be appropriately formed. To minimize such problems, the image forming apparatus 1 has a correction mode for correcting an overlay position and the density of each developer image.

In the correction mode, an image having a fixed shape, hereinafter referred to as a pattern image G1 as shown in FIG. 6, is formed on each side of a surface of the belt 27D with respect to a width direction, the pattern image G1 is read at an optical reading sensor 35 (FIG. 3), and a position for overlaying one over the other and a density are corrected.

The image forming apparatus 1 according to this embodiment has an auto correction mode in which correction is automatically made after a specified number of sheets are printed and a user-specified correction mode in which correction is made upon an instruction from a user.

Before the image forming apparatus 1 is moved, e.g. shipped from the factory, it is packaged in a box (not shown) with the four process cartridges 11 being detached from the accommodation space 7 as shown in FIG. 8.

When the image forming apparatus 1 is packaged, a spacer 40 is placed in the accommodation space 7 in which the four process cartridges 11 is to be placed, as shown in FIG. 8. The spacer 40 is designed to reduce any displacement of the belt unit 27 with respect to the main frame 2.

The process cartridges 11 are protected by a lapping material, e.g. a plastic bag, and packaged with the image forming apparatus 1.

The spacer 40 includes a support strut portion 41 and a holding portion 43. When the spacer 40 is placed in the accommodation space 7, the support strut portion 41 contacts an opposed portion 9A which is disposed on a position opposed from the flat surface portion 27E of the belt unit 27, e.g. on an inner surface of the top cover 9 in this embodiment. The holding portion 43 contacts the flat surface portion 27E of the belt unit 27.

The holding portion 43 is formed flat and contacts the flat surface portion 27E. The support strut portion 41 serves as a wall column that extends from the holding portion 43 toward the opposed portion 9A. The support strut portion 41 contacts the opposed portion 9A at its end portion. The support strut portion 41 is placed in the accommodation space 7 with being stretched between the opposed portion 9A and the flat surface portion 27E thereby reducing a chance of the belt unit 27 from slipping out of position or undesired oscillations of the belt unit 27 during movement of the image forming apparatus 1.

The support strut portion 41 is designed to be in a position between adjacent transfer rollers 17, that is, in a position displaced from a transfer roller 17 in the extending direction D1 of the belt 27D, when the spacer 40 is placed.

Figure 10B:
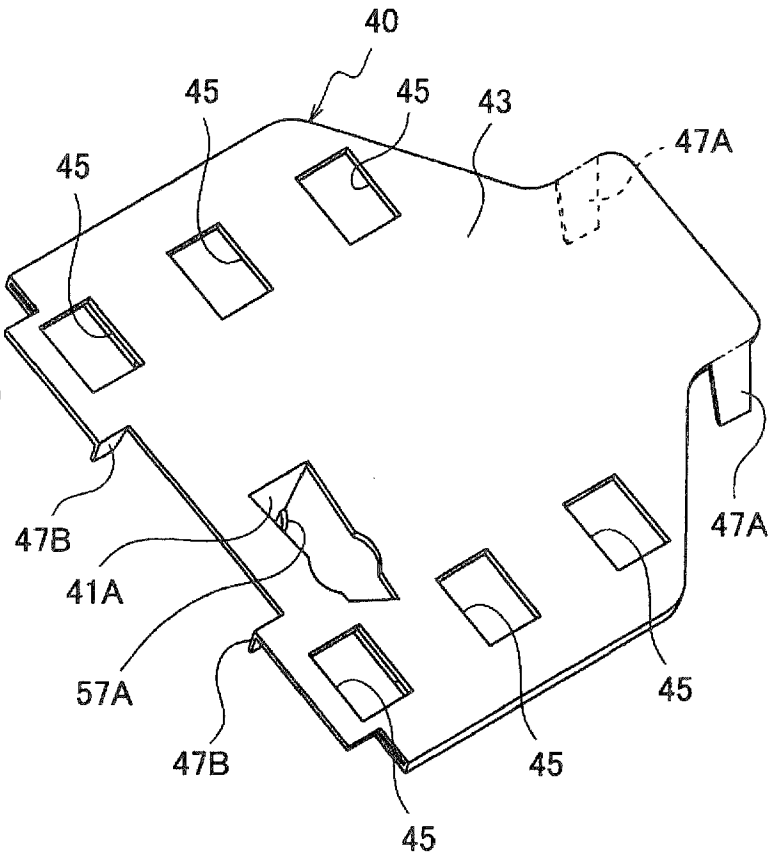
FIG. 10B is a perspective view of the spacer when viewed from a bottom surface of the spacer.
Figure 10A:
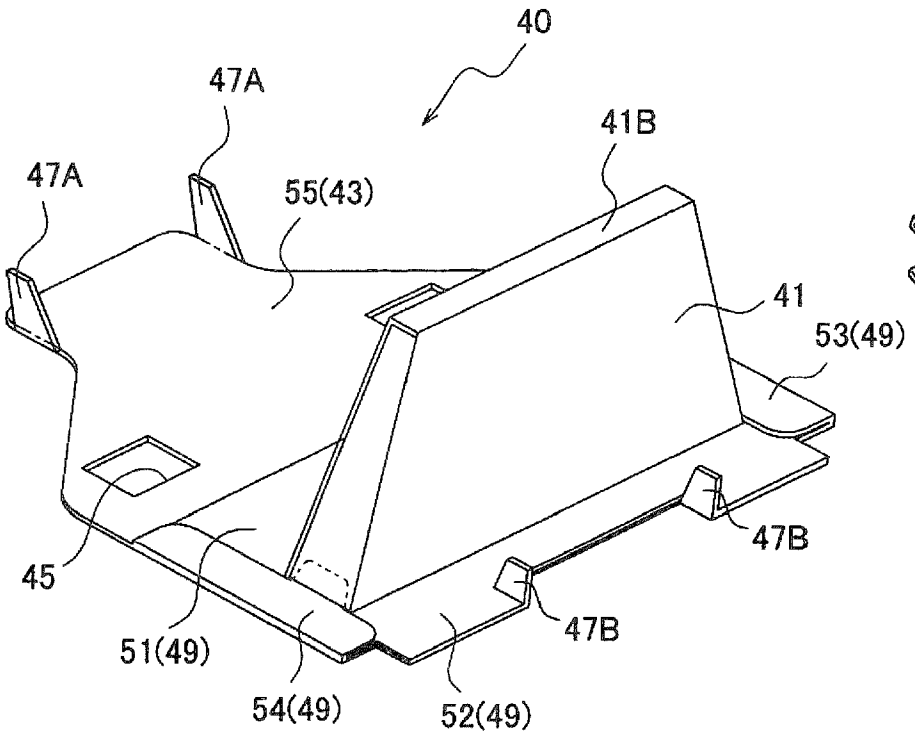
FIG. 10A is a perspective view of the spacer.

As shown in FIG. 10A, the support strut portion 41 includes a contact surface 41B that is to contact the opposed portion 9A. The contact surface 41B extends in a width direction of the opposed portion 91A, i.e. in the width direction of the image forming apparatus 1, in a range that does not interfere with other objects. The holding portion 43 extends in a width direction of the flat surface portion 27E, i.e. in the width direction of the image forming apparatus 1.

In this embodiment, as shown in FIG. 5, the engaging lever 31A is disposed on the front side of the belt frame 27C with respect to a longitudinal direction thereof, i.e. the extending direction D1, the engaging protrusion 31B is disposed on the rear end of the belt frame 27C with respect to the longitudinal direction thereof, and the four transfer rollers 17 are spaced apart between the rollers 27A and 27B. As shown in FIG. 8, when the spacer 40 is placed, the support strut portion 41 is located between the engaging lever 31A and the engaging protrusion 31B.

Specifically, when the spacer 40 is placed, the support strut portion 41 extends from the opposed portion 9A to the holding portion 43 (toward the flat surface portion 27E) between the adjacent exposure units 15. A basal portion of the support strut portion 41 is located at a position corresponding to the backup roller 33C.

Figure 9:
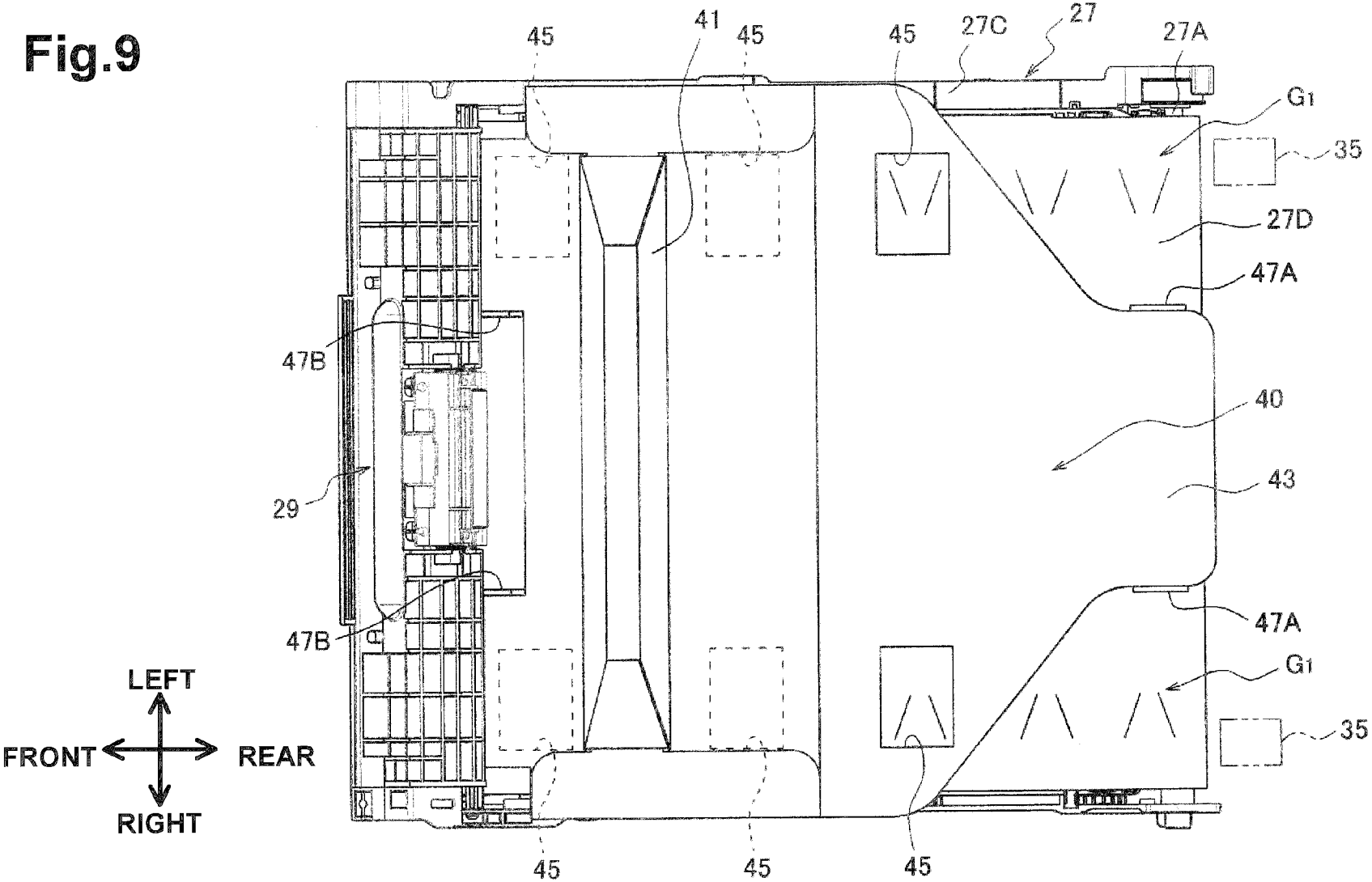
FIG. 9 is a top view of the belt unit in which the spacer is attached, when viewed from bottom.

As shown in FIGS. 9 and 10B, the holding portion 43 includes rectangular holes 45 formed in a surface to contact the flat surface portion 27E. The holes 45 are disposed in positions corresponding to the transfer rollers 17 and where the pattern images G1 are formed. Hereinafter the positions are referred to as patch formation positions.

Each of the holes 45 serves as an escape portion for decreasing the contact surface pressure between the holding portion 43 and the flat surface portion 27E in the patch formation position. Each hole 45 is not limited to a through hole, but may be an opening on one side.

As shown in FIG. 9, the holding portion 43 and the flat surface portion 27E do not contact each other at patch formation positions located near the roller 27A. As shown in FIG. 10B, the spacer 40 of the embodiment has three holes 45 on each side with respect to the width direction along the extending direction.

As shown in FIG. 8, the holding portion 43 includes stoppers 47A and 47B at opposite ends. The stoppers 47A and 47B are configured to reduce movement of the spacer 40 with respect to the belt unit 27 in the extending direction. The stopper 47A is configured to contact the partition member 7B and minimize rearward movement of the spacer 40. The stopper 47B is configured to contact the guide portion 29B of the handle portion 29 and minimize forward movement of spacer 40.

Figure 11:
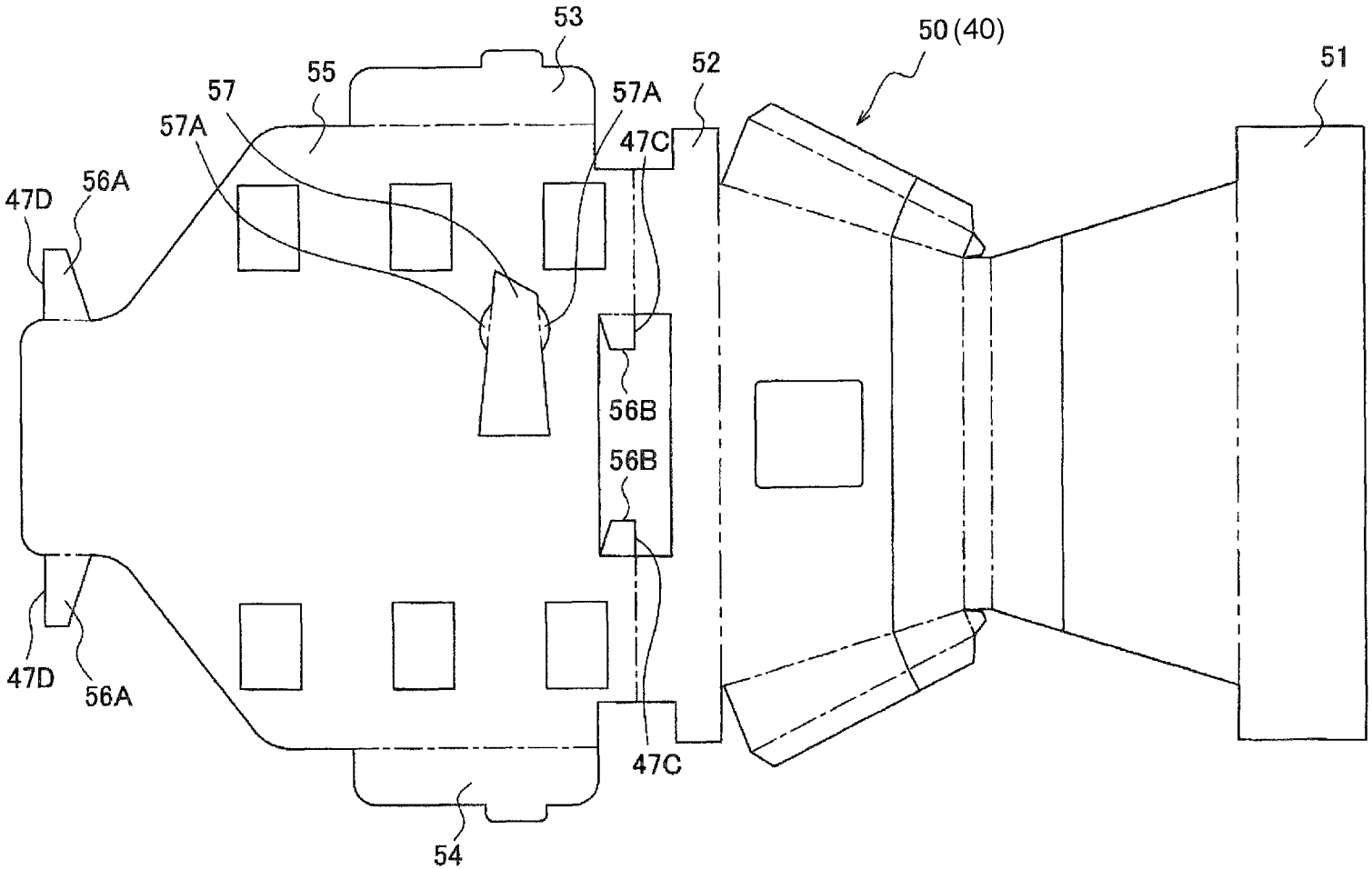
FIG. 11 is a developed view of the spacer.

As shown in FIG. 11, there is a sheet-like member 50 cut into a specified shape. The sheet-like member 50 is folded to form the spacer 40 integrally having the support strut portion 41, the holding portion 43, and the stoppers 47A and 47B. This embodiment shows, but not limited to, that a cardboard is used for the sheet-like member 50.

Figure 12A:
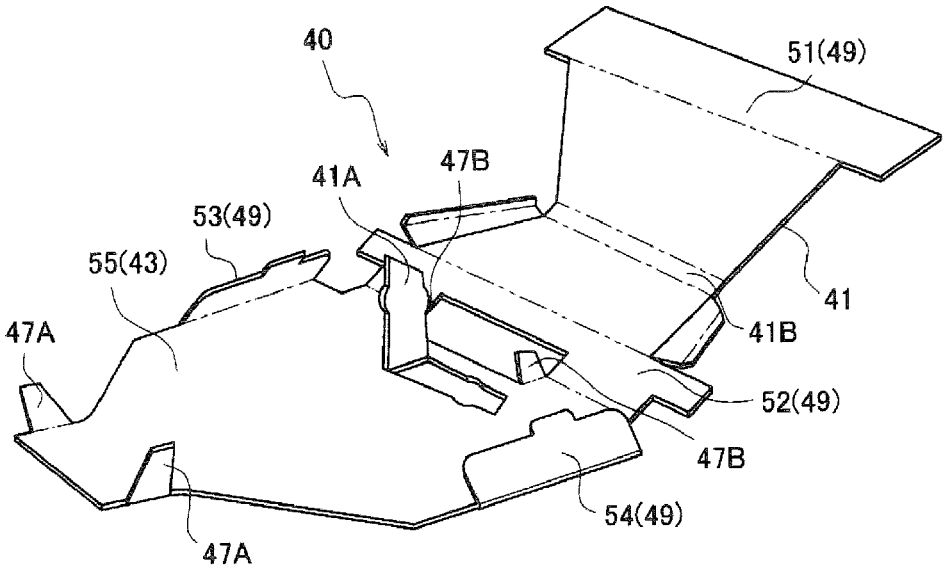
FIGS. 12A and 12B show that the spacer is folded.
Figure 12B:
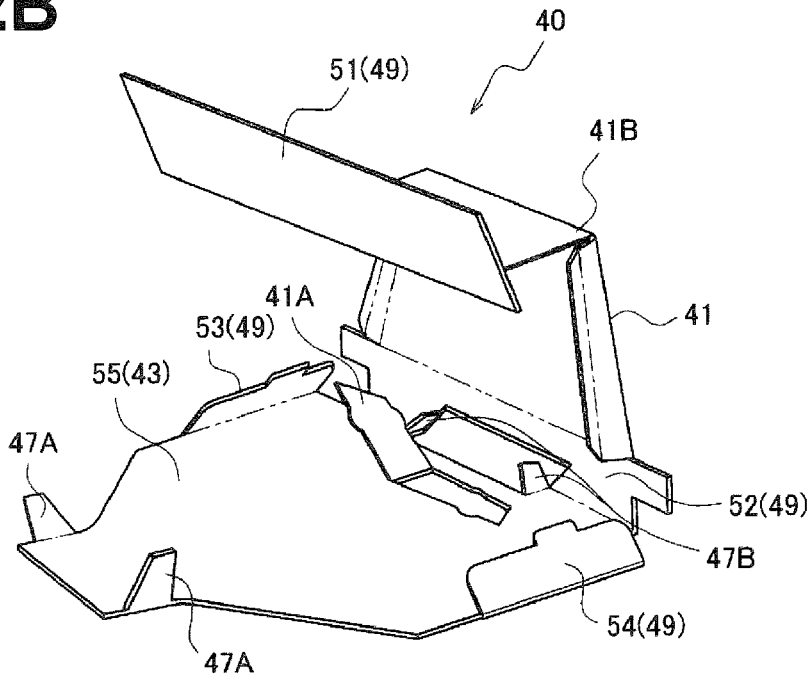
Figure 13:
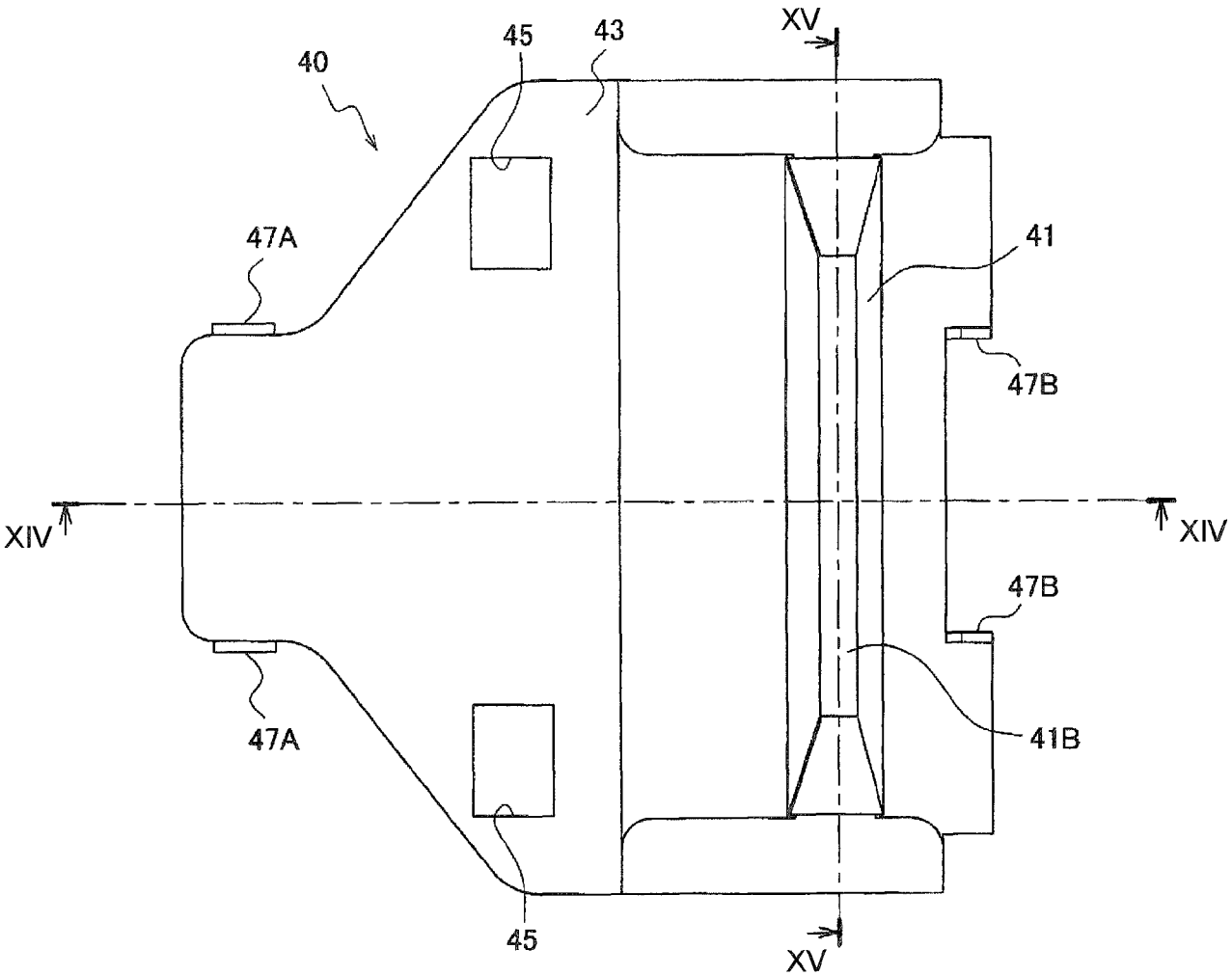
FIG. 13 is a top view of the spacer.

In FIG. 11, an alternate long and short dashed line indicates a valley fold line, and a chain double-dashed line indicates a mountain fold line. The sheet-like member 50 is folded along the valley fold line to create a V-shape, like a valley. The sheet-like member 50 is folded along the mountain fold line to create an upside-down "V" shape, like a mountain. For example, when the sheet-like member 50 is folded at fold lines in the order of FIG. 12A to FIG. 12B, the spacer 40 shown in FIG. 13 is formed.

In the embodiment, an adhesive, e.g. tape, is used to connect each part after completion of folding, thereby reducing the opportunity for the spacer 40 to return to an unfolded shape.

Figure 14:
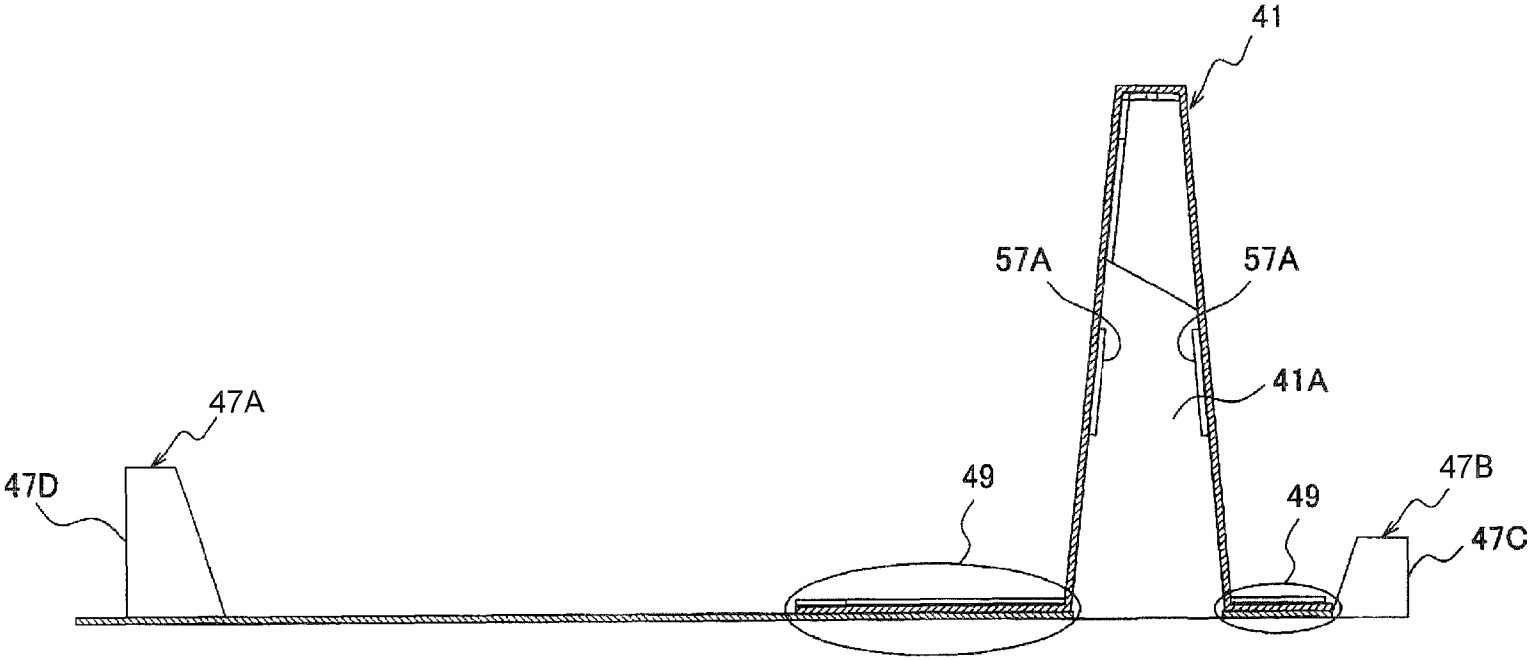
FIG. 14 is sectional view taken along the line XIV-XIV of FIG. 13.

When the sheet-like member 50 is folded, parts 51-54 shown in FIG. 11 are overlapped on a part 55 forming the holding portion 43 in a direction in which the support strut portion 41 extends, such that an overlapping portion 49 is formed around the basal portion of the support strut portion 41 as shown in FIGS. 10A and 14.

The stoppers 47A and 47B are shaped by folding parts 56A and 56B shown in FIG. 11. As shown in FIGS. 11 and 14, parts 47C of the stoppers 47B that is to contact the guide portion 29B and parts 47D of the stoppers 47A that is to contact the partition member 7B of the main body are cut surfaces, not fold lines.

Figure 15:
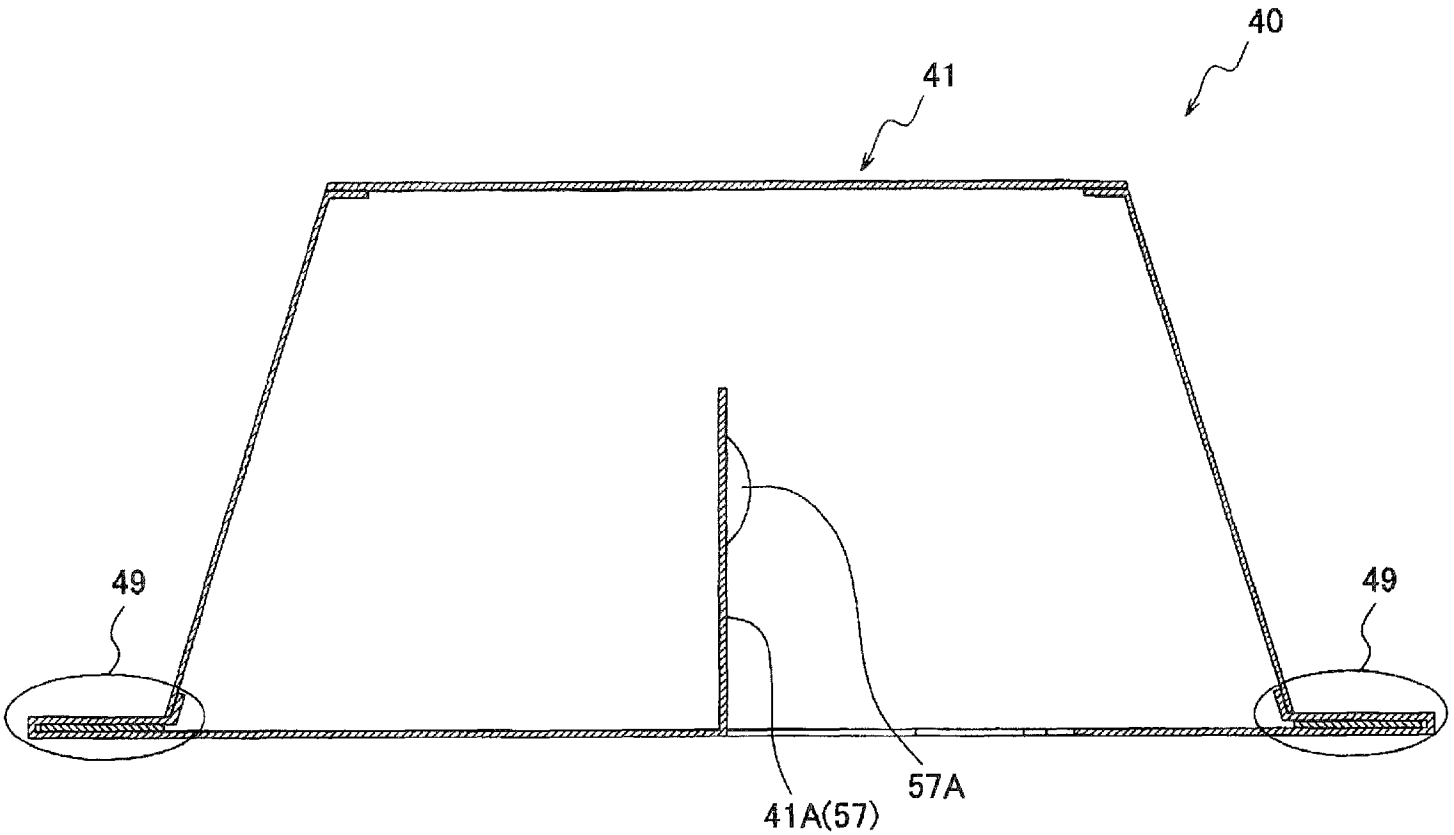
FIG. 15 is a sectional view taken along the line XV-XV of FIG. 13.

In the part 55 forming the holding portion 43 shown in FIG. 11, a part 57 is cut and to be raised toward the support strut portion 41. Parts 57A project from the part 57 toward parts 56A and 56B (forming stoppers 47A and 47B). As shown in FIGS. 14 and 15, the parts 57A are folded to contact inner walls of the support strut portion 41. Thus, the parts 57 and 57A serve as a reinforcing portion 41A that braces the support strut portion 41 in its hollow as shown in FIGS. 14 and 15.

In the embodiment, before the image forming apparatus 1 is moved, e.g. carried, the spacer 40 is placed between the belt unit 27 and the opposed portion 9A, so that the belt unit 27 is held in position. Thus, if a force acts on the image forming apparatus 1 during movement, the support strut portion 41 can minimize the belt unit 27 from slipping out of position in the main frame 2 or minimize a chance of the belt frame 27C from becoming damaged, e.g. cracked.

When the image forming apparatus 1 is not moved, e.g. when it is used, a great force required for fixing the belt unit 27 at the engaging lever 31A and the engaging protrusion 31B is not necessary. Thus, when the image forming apparatus 1 is not moved, the belt unit 27 can be held in position even without the spacer 40, which may minimize the need to increase the size of parts, e.g., the engaging lever 31A and the engaging portion 31B.

As described above, in the embodiment, the need for increasing the size of the image forming apparatus 1 can be minimized, and the chance of the belt unit slipping out of position during movement of the image forming apparatus 1 can be reduced.

In the embodiment, the holding portion 43 contacts the flat surface portion 27E to hold the belt unit 27. The holding portion 43 and the belt unit 27 can be brought in contact with each other in a relatively large area.

In the embodiment, the top cover 9 includes the opposed portion 9A that contacts the contact surface 41B of the support strut portion 41. When the top cover 9 is closed, the spacer 40 can be pressed against the belt unit 27. When the top cover 9 is open, the belt unit 27 is released from the pressure of the spacer 40. In this manner, the spacer 40 can be easily attached and removed.

In the embodiment, each transfer roller 17 is elastically supported by the coil spring 17B, so that the transfer roller 17 can be displaced in a direction crossing the flat surface portion 27E. For example, when there is a variation in distance between the flat surface portion 27E and the opposed portion 9A or in size of the spacer 40, the elastic force or deformation of the coil spring 17B can absorb the variation.

Thus, the spacer 40 can be reliably brought into contact with the flat surface portion 27E and the opposed portion 9A. Potential displacement of the spacer 40 relative to the belt unit 27 during movement of the image forming apparatus 1 can be minimized, and thus the risk of the belt unit 27 undesirably separating from the body casing can be reduced.

In the embodiment, the holding portion 43 contacts the flat surface portion 27E and holds the belt unit 27. The contact pressure between the holding portion 43 and the flat surface portion 27E at portions of the flat surface portion 27E corresponding to the transfer rollers 17 (hereinafter referred to as roller corresponding portions) tends to become increased as compared with the contact pressure at other portions because the amount of displacement of the belt 27D is controlled by the transfer rollers 17. Thus, when the holding portion 43 is displaced with respect to the flat surface portion 27E due to the oscillation in movement, the belt 27D may be damaged, e.g. worn, at the roller corresponding portions.

In the embodiment, when the spacer 40 is placed in the image forming apparatus 1, the support strut portion 41 is located between the roller corresponding portions, or located in a portion shifted from a roller corresponding portion in the extending direction. With this configuration, the contact pressure at a portion where damage highly occurs or at a roller corresponding portion can be reduced as compared with a case that the support strut portion 41 is located at the portion corresponding to the transfer roller 17, and damage to the flat surface portion 27E or the belt 27D can be minimized.

In the embodiment, when the spacer 40 is placed in the image forming apparatus 1, the support strut portion 41 is located in a position corresponding to a position between the adjacent transfer rollers 17. With the same reason as the above, damage to the belt 27D can be minimized.

In the embodiment, when the spacer 40 is placed in the image forming apparatus 1, the support strut portion 41 is located in a position corresponding to a position between the engaging lever 31A and the engaging protrusion 31B that make up the locking mechanism. Thus, the belt unit 27 can be effectively held by the spacer 40.

In other words, the belt unit 27 is fixed to the main body by the engaging lever 31A and the engaging protrusion 31B disposed at both sides in the longitudinal direction or the extending direction, and the support strut portion 41 is located in the position corresponding to the position between the engaging lever 31A and the engaging protrusion 31B. Thus, a bending moment acting on the belt unit 27 by the engaging lever 31A and the engaging protrusion 31B and a bending moment acting on the belt unit 27 by the support strut portion 41 can be easily balanced out.

Thus, the belt unit 27 can be effectively held by the spacer 40 and the potential of the belt unit 27 from being separated from the main body during the movement of the image forming apparatus 1 can be reduced.

As a surface of the holding portion 43 that contacts the belt unit 27 is formed flat, a pressing force by the spacer 40 acts on the entire belt unit 27, and thus belt unit 27 can be spared unnecessary stress during the movement of the image forming apparatus 1.

The holding portion 43 includes the holes 45 at portions corresponding to the positions of the transfer rollers 17 and the positions where the pattern images G1 are to be formed. Owing to the holes 45, damage to the belt 27D can be reduced at the portions corresponding to the positions where the pattern images G1 are to be formed. Furthermore, false detection due to the damage to the belt 27D by the reading sensor 35 can be minimized.

The holding portion 43 is provided with the stoppers 47A and 47B, which are configured to minimize movement of the spacer 40 with respect to the belt unit 27 in the extending direction. With the stoppers 47A and 47B, the spacer 40 can be positioned in place, so that the spacer 40 can function appropriately.

The belt unit 27 is provided with the backup roller 33C. During the movement of the image forming apparatus 1, a great inertial force may occur in the backup roller 33C having a relatively large mass, and the belt frame 27C may be damaged at a portion where the backup roller 33C is disposed.

In the embodiment, when the spacer 40 is placed, the support strut portion 41 is located in a portion corresponding to the backup roller 33C, and can minimize the backup roller 33C from greatly moving. With this configuration, a chance of a significant occurring in the backup roller 33C can be minimized, and thus potential for damage to the belt frame 27C can be reduced during the movement of the image forming apparatus 1.

The holding portion 43 is provided with the overlapping portion 49, which is formed around the basal portion of the support strut portion 41 by folding a part of the sheet-like member 50, e.g., parts 51-54 in the direction in which the support strut portion 41 extends. The spacer 40 can be easily and inexpensively manufactured by folding the sheet-like member 50.

The overlapping portion 49 of the holding portion 43 provides rigidity around a portion on which a pressing force from the support strut portion 41 acts. The pressing force can be transmitted from the support strut portion 41 to the holding portion 43 reliably. With this configuration, the potential for the belt unit 27 being separated from the main body during movement of the image forming apparatus 1 can be reduced.

The parts 47C and 47D of the stoppers 47A and 47B that are to receive pressing force in contact with the other parts are formed by cutting. Thus, dimensional variations in the parts 47C and 47D are the same as those in cutting.

The dimensions of the parts 47C and 47D formed by cutting do not vary greatly when compared with a case where the sheet-like member 50 is folded to create portions that contact the belt unit 27 and the main body. Thus, the stoppers 47A and 47B can be reliably brought into contact with the belt unit 27.

A part of the holding portion 43 is cut and folded to function as the reinforcing portion 41A that braces the support strut portion 41. With such a simple configuration, the rigidity of the support strut portion 41 can be improved.

The parts 57A protruding from the part 57 that forms the reinforcing portion 41A are folded and brought into contact with the inner walls of the support strut portion 41. Thus, the reinforcing portion 41A can be retained in place within the support strut portion 41, so that the reinforcing portion 41A can function reliably.

Figure 16:
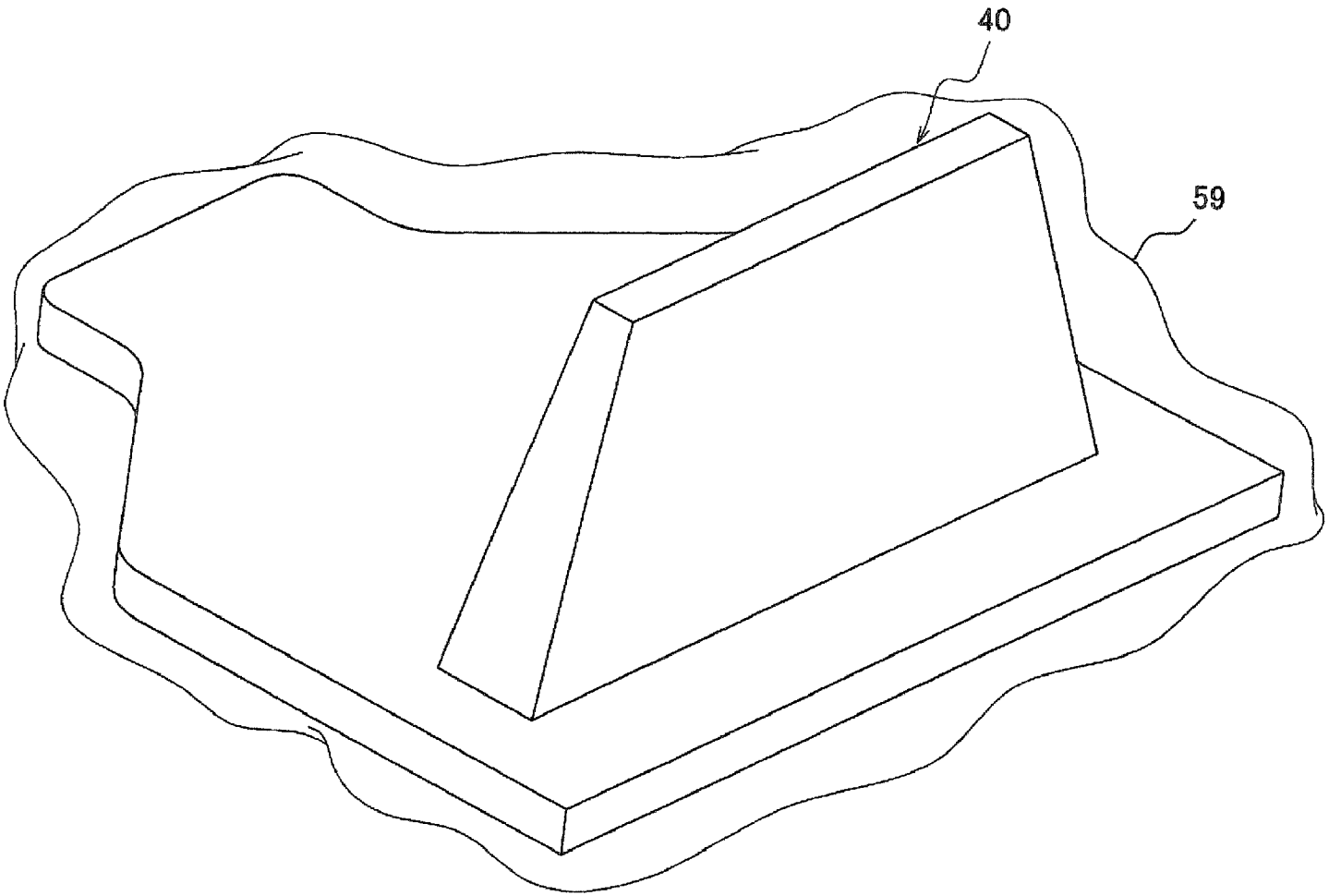
FIG. 16 is a perspective view of a spacer according to another illustrative embodiment.

A second embodiment will be described with reference to FIG. 16.

In the second embodiment, the spacer 40 is formed of a resin foam, e.g. foamed polyethylene, and covered with a covering material 59, e.g. a sheet of polyethylene. The covering material 59 covers at least a side of the holding portion 43 opposite from the support strut portion 41 that faces the flat surface portion 27E.

With this configuration, even when the holding portion 43 and the flat surface portion 27E rub against each other due to the vibration occurring during movement of the image forming apparatus 1, the covering material 59 can minimize wear particles from being produced from the holding portion 43 and being scattered within the image forming apparatus 1.

The wear particles are foreign matter such as dust particles that are produced when the holding portion 43 is rubbed. In this embodiment, as the holding portion 43 of the spacer 40 is formed of a resin foam, e.g. foamed polyethylene, the wear particles tend to be produced.

In this embodiment, the holding portion 43 has thickness greater than that of the first embodiment, and end surfaces of the holding portion 43 function as stoppers equivalent to the stoppers 47A and 47B of the first embodiment.

In the above illustrative embodiments, the invention is applied to, but not limited to, a direct tandem type image forming apparatus.

In the above illustrative embodiments, the image forming apparatus is provided with exposure devices using LED arrays. However, the invention is not limited to the LED array exposure devices. The exposure devices may comprise a laser scanner that emits laser beams.

In the above illustrative embodiments, the belt unit 27 is configured to feed a recording medium. However, the invention is not limited to this kind of belt unit. The invention may be applied to a belt unit of intermediate transfer type. Unless otherwise described herein, the term "transfer unit" is intended to cover both belt units that convey recording mediums and belt units that convey toner images to recording mediums.

In the above illustrative embodiments, only one support strut portion 41 is used. The invention is not limited to this. A plurality of support strut portions may be provided.

In the above illustrative embodiments, the extending direction agrees with a substantially horizontal direction. However, the invention is not limited to the substantially horizontal direction. The invention may be applied to an image forming apparatus in which the extending direction agrees with a vertical direction.

Although an illustrative embodiment and examples of modifications of the present invention have been described in detail herein, the scope of the invention is not limited thereto. It will be appreciated by those skilled in the art that various modifications may be made without departing from the scope of the invention. Accordingly, the embodiment and examples of modifications disclosed herein are merely illustrative. It is to be understood that the scope of the invention is not to be so limited thereby, but is to be determined by the claims which follow.

What is claimed is:

1. An apparatus comprising:

a main body including an opposed portion and defining a space for receiving one or more process cartridges configured to form an image on a recording medium;

a transfer unit disposed in the main body, the transfer unit including a pair of rollers spaced apart, a frame supporting the rollers, and an endless belt extending around the rollers, the belt including an extending portion facing the opposed portion of the main body;

a locking mechanism configured to fix the transfer unit in the main body; and a spacer, different from the one or more process cartridges, disposed between the transfer unit and the opposed portion of the main body, the spacer including a first contact portion, a second contact portion that is spaced apart from the first contact portion, and a connection portion that connects the first and second contact portions, the first contact portion being configured to contact the opposed portion, the second contact portion being configured to contact the extending portion of the endless belt.

2. The apparatus according to claim 1, wherein the main body includes an opening and a cover that is configured to move between a closed position where the opening is closed and an open position where the opening is released, and the opposed portion is disposed on the cover.

3. The apparatus according to claim 2, further comprising:

a plurality of exposure devices, each exposure device including an LED array in which a plurality of light emitting diodes are arranged in a direction parallel to an axial direction of the rollers of the transfer unit, wherein the cover is pivotally coupled to a top surface of the main body, the exposure devices are assembled to the cover and spaced apart in the extending direction when the cover is in the closed position, and the first contact portion is located in a position corresponding to a position between the exposure devices adjacent to each other.

4. The apparatus according to claim 1, wherein the first and second contact portions define the space for receiving the one or more process cartridges, each of the one or more process cartridges including a photosensitive member on which a developer image is carried, wherein the transfer unit further includes a transfer member disposed on a side of the extending portion opposite from the space, the transfer member being configured to transfer the developer image carried on the photosensitive member; and wherein the transfer unit further includes an elastic member assembled in the frame of the transfer unit, the elastic member being configured to move the transfer member in a direction crossing an extending direction in which the extending portion of the belt extends.

5. The apparatus according to claim 4, wherein the transfer member includes a plurality of transfer members spaced apart in the extending direction, and the first contact portion is located at a position corresponding to a position between the transfer members adjacent to each other.

6. The apparatus according to claim 4, wherein the second contact portion includes a first area corresponding to the transfer member, and a second area shifted from the transfer member, and the first area is configured to reduce a contact surface pressure between the second contact portion and the transfer unit compared with the second area.

7. The apparatus according to claim 6, wherein the main body includes a reading sensor that is configured to read a pattern image to be formed on a surface of the belt opposite from the transfer member, and the first area of the second contact portion is located in a position corresponding to a position in which the pattern image is to be formed.

8. The apparatus according to claim 1, wherein the first contact portion is located at a position shifted from a position corresponding to the transfer member in the extending direction.

9. The apparatus according to claim 1, wherein the locking mechanism includes a first engaging portion and a second engaging portion shifted in the extending direction from the first engaging portion, each of the first engaging portion and the second engaging portion is configured to engage the transfer unit to the main body, and the first contact portion is located in a position corresponding to a position between the first engaging portion and the second engaging portion.

10. The apparatus according to claim 1, wherein the second contact portion includes a stopper that is configured to restrict movement of the spacer with respect to the transfer unit.

11. The apparatus according to claim 1, further comprising:

a belt cleaner disposed in the main body and configured to remove substances adhered to the belt; and a backup member disposed in the frame and configured to press the belt toward the belt cleaner, wherein the first contact portion is located in a position corresponding to the backup member.

12. The apparatus according to claim 1, further comprising at least two rollers spaced apart from each other inside the belt and between the pair of rollers of the transfer unit, wherein the second contact portion has a flat surface configured to contact the extending portion of the belt, and wherein the extending portion of the belt is sandwiched between the flat surface of the second contact portion of the spacer and the at least two rollers spaced apart from each other inside the belt.

13. A spacer for use in an apparatus including a transfer unit in a main body, the transfer unit including a pair of rollers spaced apart, a frame holding the rollers, and an endless belt extending around the rollers, the belt including an extending portion, the spacer being configured to minimize the transfer unit from moving out of position with respect to the main body, the spacer comprising:

a first contact portion contacting an opposed portion, wherein the opposed portion is a part of the main body, the opposed portion facing the extending portion of the belt of the transfer unit;

a second contact portion spaced apart from the first contact portion, the second contact portion having a flat surface configured to contact the extending portion of the belt; and a connection portion extending between the first contact portion and the second contact portion.

14. The spacer according to claim 13, further comprising a covering member configured to cover at least a side of the second contact portion facing the transfer unit.

15. The spacer according to claim 13, wherein the first and second contact portions and the connection portion are integrally formed by folding a sheet member cut to a predetermined shape, the second contact portion includes an overlapping portion in which a part of the sheet member is overlapped in a direction in which the connection portion extends, and the overlapping portion is provided around the connection portion.

16. The spacer according to claim 15, wherein the second contact portion includes a stopper that is configured to restrict movement of the transfer unit by contact therewith, and the stopper includes a cut surface that contacts the transfer unit.

17. The spacer according to claim 15, wherein a part of the second contact portion is cut and raised to form a reinforcing portion being configured to brace the connection portion.

18. The spacer according to claim 15, wherein the second contact portion includes a hole.

19. The spacer according to claim 13, wherein the extending portion of the belt is sandwiched between the flat surface of the second contact portion and at least two rollers spaced apart from each other inside the belt and between the pair of rollers of the transfer unit.

* * * * *